United States Patent [19]

Robbins

[11] Patent Number: 4,513,221

[45] Date of Patent: Apr. 23, 1985

[54] CRT INTERNAL SHIELDING MEANS FOR A SPUN GLASS ENVELOPE FUNNEL SECTION

[75] Inventor: John D. Robbins, Seneca Falls, N.Y.

[73] Assignee: North American Philips Consumer Electronics Corp., New York, N.Y.

[21] Appl. No.: 352,682

[22] Filed: Feb. 26, 1982

[51] Int. Cl.[3] ..... H01J 29/80; H01J 29/86; H01J 1/52

[52] U.S. Cl. ..... 313/402; 313/479; 315/85

[58] Field of Search ..... 313/402, 477 R, 479, 313/407; 220/2.1 A; 315/85

[56] References Cited

U.S. PATENT DOCUMENTS

| | | | |
|---|---|---|---|
| 3,005,122 | 10/1961 | Coleman et al. | 220/2.1 A |
| 3,959,686 | 5/1976 | Davis et al. | 313/479 X |
| 4,069,354 | 1/1978 | Pekosh | 313/477 R X |
| 4,198,587 | 4/1980 | Vehoeven et al. | 313/402 |
| 4,467,241 | 8/1984 | Hines | 313/477 R |

*Primary Examiner*—Palmer Demeo
*Assistant Examiner*—Sandra L. O'Shea
*Attorney, Agent, or Firm*—Thomas A. Briody; Jack Oisher; John C. Fox

[57] ABSTRACT

The invention relates to internal magnetic shielding means for a cathode ray tube using a spun-funnel envelope portion. The sidewall of the shielding structure is of discretely shaped contour to provide a desired spatial compatibility with at least portions of a projecting glass ridge on the interior surface of the funnel.

2 Claims, 4 Drawing Figures

CRT INTERNAL SHIELDING MEANS FOR A SPUN GLASS ENVELOPE FUNNEL SECTION

TECHNICAL FIELD

This invention relates to internal magnetic shielding means for a cathode ray tube (CRT) and more particularly to a shielding member formed to provide improved spatial compatibility with the spun glass funnel section of the encompassing envelope.

BACKGROUND ART

Cathode ray tubes, especially those types used in color television and related display applications, are often provided with magnetic shielding means to protect the tube from the deleterious effects of numerous stray voltages, currents, and magnetic fields, including the earth's magnetic field, which tend to adversely influence the desired performance of the tube. While shielding means externally surrounding the frontal portion of the tube have been extensively utilized, it has been found that magnetic shields formed for internal spaced positioning within the tube envelope provide more efficient shielding effects.

A typical internal shielding member conventionally evidences a substantially continuous bowl-like sidewall having a substantially full frontal opening facing the screen region of the tube and a smaller rear-oriented opening. The front portion of the shield is usually affixed to and supported by the frame structure of the shadow mask which is oriented adjacent the screen of the tube. The discretely curved shaping of the shielding member permits close spacing thereof within the encompassing forward region of the funnel portion of the tube envelope. Being so oriented in close adjacency to the funnel, the shield is beneficially demagnetized or neutralized by a degaussing field generated by conventional degaussing means positioned externally of the tube.

In accordance with the state of the art, pressed glass envelope funnels are commonly used in tube manufacture, but some tubes are fabricated with spun glass funnels, sometimes referred to as spin-to-ring funnels. This latter denoted funnel evidences a unique structure in important areas. By the spinning technique of manufacture, the centrifugal movement of material usually produces a substantially continuous built-up strengthening ridge of accumulated glass around the interior surface of the funnel.

Using a conventional internal shielding member, of the type described, with a spun glass funnel necessitates having the sidewall of the shield spaced inward from the interiorly protruding ridge of glass evidenced in the wall of the funnel. This constructional relationship results in an over-all wider than desired shield-to-funnel spacing, which presents the possibility of at least two detrimental conditions. Namely, the shield-to-funnel spatial relationship can be of a width to permit the uncontrolled passage of electron beam overscan therethrough to detrimentally impinge the edge area of the screen. Secondly, as a result of the necessitated wide spacing, the sidewall of the shielding member is further removed from the beneficial effects of the externally initated degaussing field.

SUMMARY OF THE INVENTION

Figure 1:
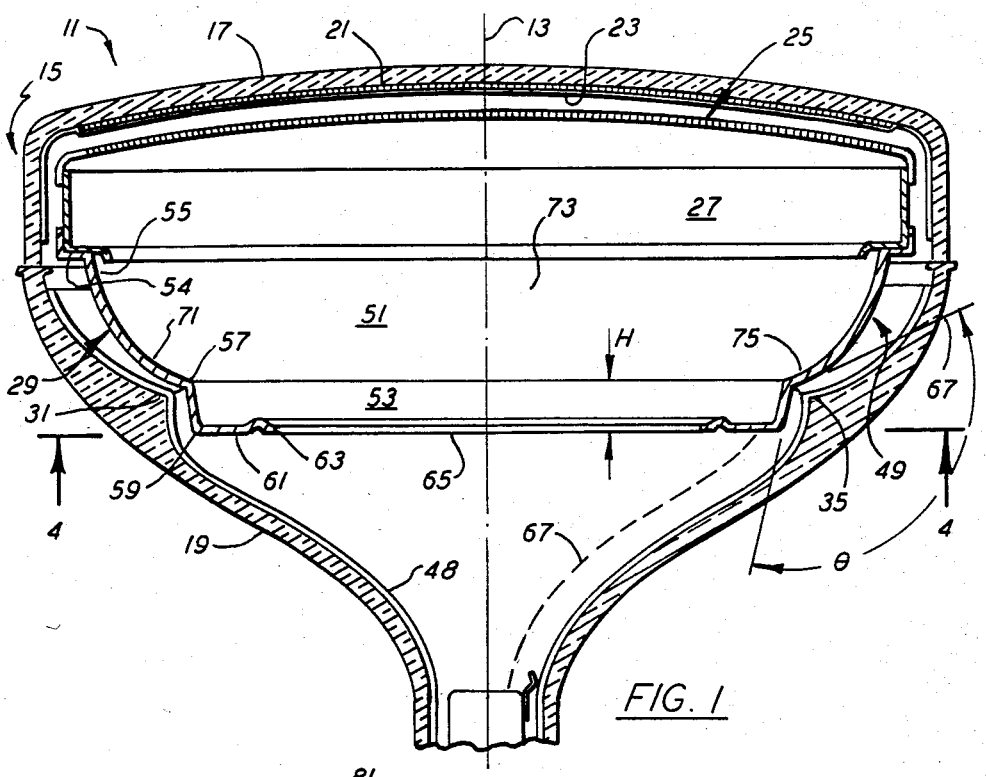
FIG. 1 is a sectional view of a color cathode ray tube fabricated of a spun glass funnel showing the internal shielding member wherein the invention resides.

The invention relates to improved internal magnetic shielding means formed for spatial positioning within the spun glass funnel (herein "spun-funnel") section of a cathode ray tube envelope. Spun-funnels inherently evidence a substantially continuous built-up ridge or bump of accumulated glass formed around the interior surface thereof.

In accordance with the broad aspects of the invention, the shielding means is a discretely shaped member having a substantially continuous sidewall formation defining frontal and rear openings and having an axis therethrough. This sidewall is demarcated by integrally related major and minor parallel portions, normal to the axis, which jointly produce a contour that is in keeping with at least portions of the internal contour of the funnel, thereby beneficially minimizing the spacing therebetween.

The major portion of the shield sidewall is formed about the axis as a flared skirt-like shaping defining a substantially full frontal opening from which the shaping extends rearward in a constricted manner to a region of reduced periphery, whereat the minor portion of the sidewall is integrally formed thereabout, at a defined transitional region, as a band-like waist formation. The terminal perimeter of the waist is bounded by a continuous ledge instanding in a common plane from the perimeter toward the axis. The terminal edge of this ledge defines the rear opening of the shielding member, such being smaller than the frontal opening thereof. The aforementioned transitional region between the flared and waist sidewall formations is indented toward the axis to form a substantially continuous re-entrant angle between the sidewall portions. At least discrete portions of this angular construction are oriented to be spatially adjacent determinate regions of the glass ridge protruding from the interior surface of the spun-funnel, thereby achieving a compatible shield-to-funnel relationship.

The minor or waist sidewall formation is of a height and angular orientation to spatially cooperate with the glass ridge to effectively block the passage of electron beam overscan through the spacing separating the shield and funnel.

Specifically, the preferred embodiment of the invention pertains to rectangular tubes, employing funnels of substantially rectangular frontal opening, wherein the shielding member is formed to be spatially compatible therewith. In rectangular color CRT's, the corner regions of the screen are particularly vulnerable to image distortion and color dilution. Therefore, it is important to provide adequate degaussing and shielding to those areas. Beneficially, the re-entrant angular transition region of the improved shielding means is substantially spatially adjacent the glass ridge in the corner regions of the funnel. This relationship achieves efficient blocking of beam overscan from the shield-to-funnel spacing, and positions the shield sidewall thereat in a strong degaussing field.

DESCRIPTION OF THE PREFERRED EMBODIMENT

With reference to the drawings, there is shown in FIG. 1 an exemplary color cathode ray tube 11 employing the improved shielding means of the invention. While the invention is applicable to round, ovate and rectangular tubes, or variations thereof, the description herein is directed particularly to rectangular tubes. The CRT 11 has a longitudinal axis 13 therethrough and embodies an envelope 15 comprised of an integration of a viewing panel 17 and a spun-funnel portion 19. Adhered to the inner surface of the viewing panel 17 is a patterned cathodoluminescent screen 21 formed of a multitude of discrete areas of color-emitting phosphor materials with or without an associated light absorbing matrix. A thin metallized film 23, such as aluminum, is usually applied over the interior surface of the screen and a portion of the sidewall area of the panel.

A multi-opening structure or shadow mask member 25 is spatially related to the patterned screen 21, such being predeterminately positioned within the viewing panel 17 by suitable means, not shown.

Securely attached to the rear portion of the mask frame 27 is the improved inner-shield or internal magnetic shielding means 29. This structure being formed of thin metal, such as cold rolled steel, is discretely shaped to be compatible with the encompassing glass spun-funnel 19.

Figure 2:
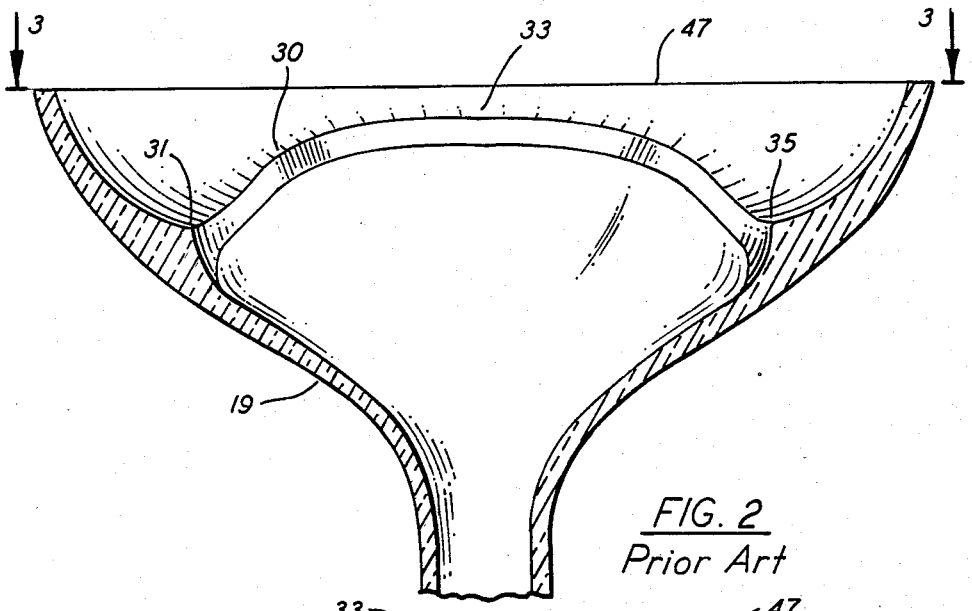
FIG. 2 Prior Art
FIG. 2 is a sectional view of the prior art spun glass funnel as utilized in the tube shown in FIG. 1, taken along the line 1—1 of FIG. 3 that being substantially across two corner sections thereof and of similar orientation to the tube section of FIG. 1.
Figure 3:
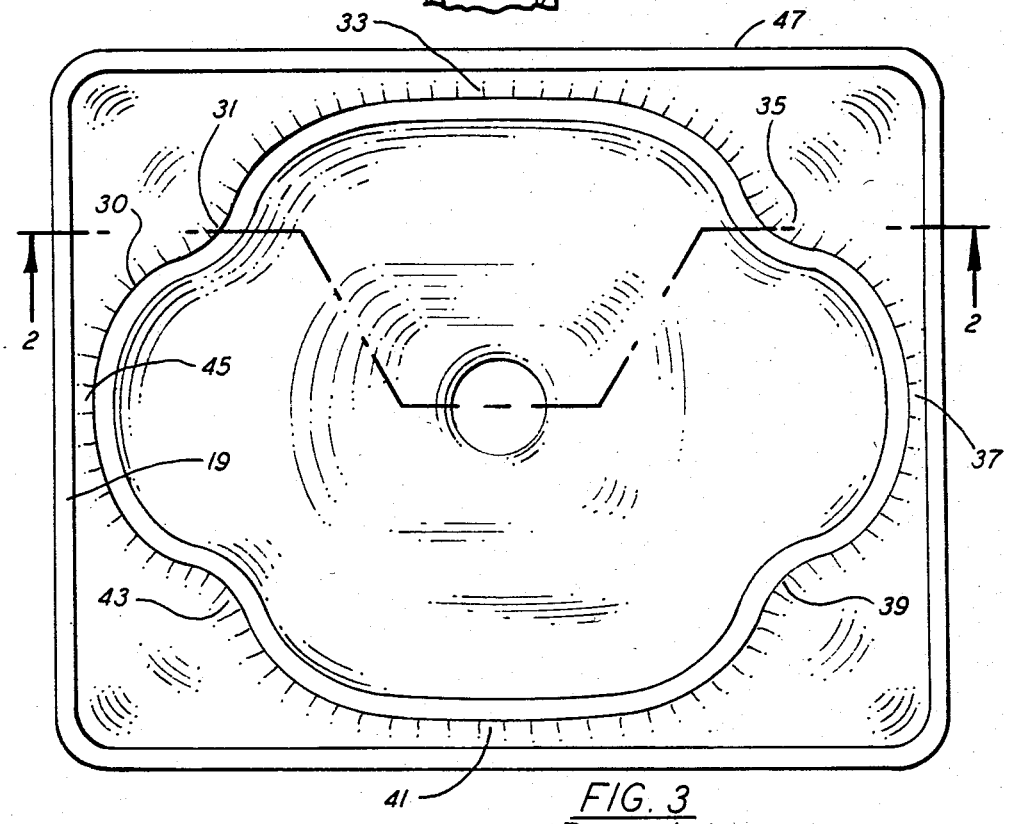
FIG. 3 Prior Art
FIG. 3 is a plan view of the prior art spun glass funnel shown in FIG. 2, taken along the line 3—3 thereof.

This rectangular spun-funnel, is further detailed in Prior Art FIGS. 2 and 3. In fabrication, the centrifugal movement of the soft glass caused by spinning produces a strengthening feature in the form of a substantially built-up bump or ridge 30 of accumulated glass around the interior of the funnel. The build up of glass in the corner regions 31, 35, 39 and 43 limits the outward movement of the ridge formation thereat. While along the side regions 33, 37, 41 and 45, the ridge of glass is moved to locations nearer the sealing lip 47 of the funnel. Thus, in rectangular tubes the ridge 30 is of wavy orientation manifesting dips in the corner areas. As previously mentioned, it is important to have efficient shielding and degaussing, especially in the corner regions.

Figure 4:
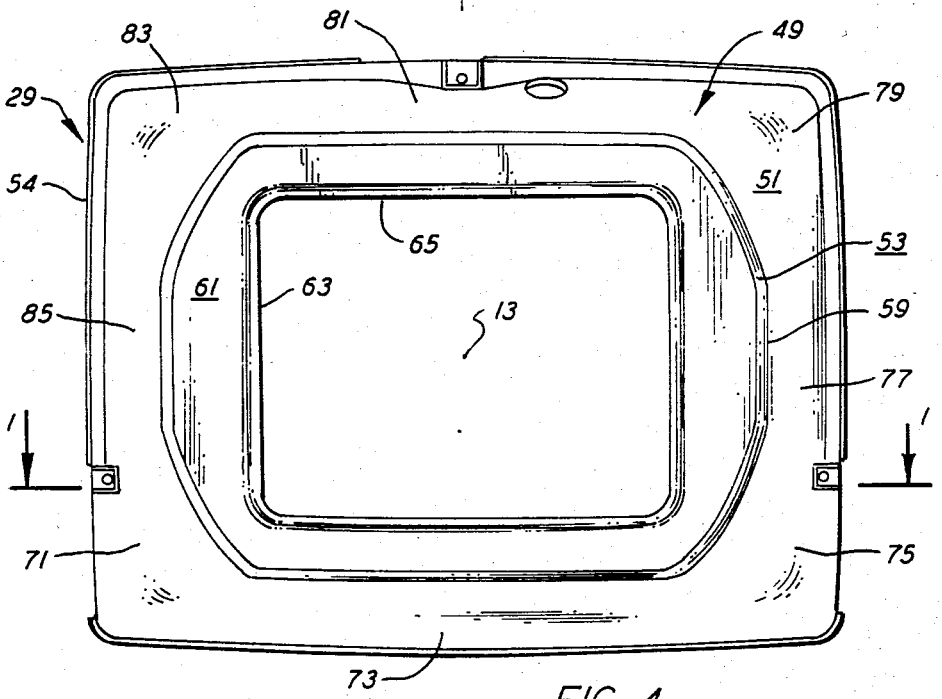
FIG. 4 is a rear plan view of only the internal shielding member taken along the line 4—4 of FIG. 1.

The tube section illustrated in FIG. 1 incorporates the funnel section of FIG. 2, such having an internal conductive coating 48 applied thereon. Accommodated therein is the improved shielding means 29, which is shown as an individual structure in FIG. 4, as viewed from the line 4—4 of FIG. 1.

This shielding means is a shaped member having a substantially continuous sidewall formation 49 that is comprised of major and minor portions 51 and 53 with an axis 13 therethrough. The major sidewall portion 51 is formed about the axis 13 as a flared skirt-like shaping having a substantially full frontal opening 55 defined by the outstanding terminal flange 54, which is affixed to the mask frame 27. From this frontal region, the major sidewall shaping 51 extends rearward in a constricted manner to a transition region 57 of reduced periphery.

The minor sidewall portion 53, being integral with the major portion and about the axis 13, is formed as a band-like waist extending rearward from the reduced periphery 57 of the flared major portion 51, which periphery 57 constitutes a defined transitional region thereabout. The waist formation 53 has a terminal perimeter 59 demarcated by a continuous ledge 61 instanding in a common plane toward the axis 13. The terminal edge 63 of the ledge defines the rear opening 65 of the shielding member, which is smaller than the frontal opening 55 thereof.

The transitional region 57 between the flared 51 (major) waist and 53 (minor) sidewall portions is denoted as an indentation toward the axis 13. This constitutes a substantially continuous re-entrant angle "$\theta$" formed of sides represented by the waist 53 and a line 67 tangential to the flared portion 51, adjacent the transition region 57. This angle determines the orientation of the waist portion relative to a spatially adjacent region of the glass ridge protruding from the interior surface of the funnel. For example, in the rectangular tube, the shielding member 29 evidences corner regions 71, 75, 79 and 81 which are spatially related to the respective funnel corner regions 31, 35, 39 and 43. This spatial relationship influenced by the re-entrant angle "$\theta$", positions the waist portion 53 and integral flared portion 51 in beneficially close proximity to the funnel. Additionally, the waist portion 53 has a height "H" sufficient to spatially cooperate with the adjacent glass ridge to effectively block the passage of overscanned electron beams 69 from the space between the shield sidewall and the funnel.

Even though the transition region 57 is in a common plane, while the glass ridge deviates toward the sealing lip 47 in the side regions, the height "H" of the waist and the distally oriented ridge act as conjunctive deterrents in blocking the passage of overscanned electron beams in those regions.

In addition, the improved shielding member permits that structure to be spaced beneficially close to the contoured glass sidewall of the spun funnel thereby enabling enhanced access to the degaussing field.

INDUSTRIAL APPLICABILITY

The internal magnetic shielding means of the invention represents a marked improvement in the manufacture of cathode ray tubes employing shields in spun-funnel envelope portions. The invention provides a tube of improved quality by inhibiting the passage of overscanned electron beams through the shield-to-funnel spacing while bettering the position of the shield relative to the degaussing field.

I claim:

1. Internal magnetic shielding means formed for spatial positioning within the glass spun-funnel section of a CRT envelope, said spun-funnel having a substantially continuous built-up ridge of accumulated glass formed around the interior surface thereof, said shielding means being a shaped member having a substantially continuous sidewall formation with an axis therethrough characterized by a structure comprising:

a major sidewall portion formed about said axis as a flared skirt-like shaping defining a substantially full frontal opening and extending rearward in a constricted manner to a region of reduced periphery; and a minor sidewall portion formed about said axis as a band-like waist formation integral with and extending rearward from the reduced periphery of said flared shaping at a defined transitional region normal to said axis, said waist formation having a terminal perimeter demarcated by a continuous ledge instanding in a common plane from said perimeter toward said axis with the terminal edge thereof defining a rear opening of said member smaller than the frontal opening thereof, said transitional region between said flared and waist sidewall formations being indented toward said axis as the apex of a substantially continuous re-entrant angle, whereby at least discrete portions thereof may be spatially adjacent determinate regions of said glass ridge on said spun-funnel envelope section.

2. The CRT spun-funnel related internal shielding means according to claim 1 wherein said shielding member has a substantially rectangular frontal opening, and wherein the re-entrant angular transition region of said shielding member is oriented to be substantially spatially adjacent said glass ridge in substantially the corner regions of a compatibly shaped funnel.

* * * * *